US010935337B2

(12) United States Patent
Delgado Acarreta et al.

(10) Patent No.: US 10,935,337 B2
(45) Date of Patent: Mar. 2, 2021

(54) DEVICE AND METHOD FOR SECURING FIREARMS

(71) Applicant: Rade Tecnologias, S.L., Saragossa (ES)

(72) Inventors: Raul Delgado Acarreta, Saragossa (ES); Diego Lorente Algora, Saragossa (ES); Ruben Robles Perez, Saragossa (ES)

(73) Assignee: RADE TECHNOLOGIAS, S.L., Saragossa (ES)

( * ) Notice: Subject to any disclaimer, the term of this patent is extended or adjusted under 35 U.S.C. 154(b) by 0 days.

(21) Appl. No.: 16/478,129

(22) PCT Filed: Jan. 17, 2017

(86) PCT No.: PCT/ES2017/070024
§ 371 (c)(1),
(2) Date: Jul. 16, 2019

(87) PCT Pub. No.: WO2018/134447
PCT Pub. Date: Jul. 26, 2018

(65) Prior Publication Data

US 2020/0096274 A1 Mar. 26, 2020

(51) Int. Cl.
*F41A 17/46* (2006.01)

(52) U.S. Cl.
CPC ..... *F41A 17/46* (2013.01)

(58) Field of Classification Search
CPC ..... F41A 17/46
USPC ..... 89/142, 148; 42/70.06
See application file for complete search history.

(56) References Cited

U.S. PATENT DOCUMENTS

| | | | | |
|---|---|---|---|---|
| 2,436,267 | A * | 2/1948 | Rogers | F41A 17/20 42/70.03 |
| 5,623,114 | A * | 4/1997 | Soper | F41A 19/46 89/141 |
| 6,256,917 | B1 * | 7/2001 | Findlay | F41A 17/02 42/70.06 |
| 6,880,281 | B1 * | 4/2005 | Orr | F41A 17/46 42/69.01 |
| 9,222,743 | B1 | 11/2015 | Shah | |
| 2003/0213159 | A1 * | 11/2003 | Cutini | F41A 17/46 42/70.06 |
| 2011/0185615 | A1 * | 8/2011 | Gangl | F41A 19/10 42/69.01 |
| 2014/0305017 | A1 | 10/2014 | Travis | |
| 2015/0068090 | A1 * | 3/2015 | Christensen | F41A 17/82 42/69.01 |
| 2016/0061549 | A1 | 3/2016 | Patterson | |

(Continued)

OTHER PUBLICATIONS

International Search Report ("ISR") of the corresponding PCT Patent Application.

*Primary Examiner* — Bret Hayes
(74) *Attorney, Agent, or Firm* — Don D. Cha; HDC IP Law, LLP

(57) ABSTRACT

The device comprises a trigger and a first safety, the invention focusing on the fact that the device comprises a second safety which actuates independently of the first safety, said second safety comprising an actuating element and a safety body, made from a single piece or independent pieces joined together when they move, such that the second safety determines the state of the weapon, between at least a firing state and safe state. Likewise, the invention relates to the method for securing firearms.

13 Claims, 7 Drawing Sheets

(56) References Cited

U.S. PATENT DOCUMENTS

| | | | | |
|---|---|---|---|---|
| 2016/0084599 | A1* | 3/2016 | Alicea, Jr. ..... | F41A 17/46<br>42/70.06 |
| 2016/0341506 | A1 | 11/2016 | Steele | |

* cited by examiner

DEVICE AND METHOD FOR SECURING FIREARMS

CROSS-REFERENCE TO RELATED APPLICATIONS

This application is a 35 U.S.C. § 371 U.S. National Stage Application of PCT Patent Application No. PCT/ES2017/070024, filed Jan. 17, 2017, which is incorporated herein by reference in its entirety.

TECHNICAL FIELD OF THE INVENTION

The present invention relates to a device and method for securing firearms, which has an application in the arms industry, and more specifically in the field of safeties for automatic and semi-automatic weapons, even including the adaptation of already existing weapons by incorporating the device of the invention which is made up of a safety that is additional to and independent of the manual safety of that weapon. A particularly advantageous, but not limiting, application of the invention is its use in shooting ranges where inexperienced users participate in shooting sessions for training purposes, such that a controlling user can control the state of all of the weapons present in the range through this additional safety included in the selector.

BACKGROUND OF THE INVENTION

Currently there are different types of firearms, both semi-automatic and automatic, similar to the semi-automatic AR15 rifle, as well as its equivalent to the U.S. Military M16 rifle, which is automatic, that can be used both in the civilian and military sector. All of these weapons are similar in that they comprise a selector, which is used to modify the state of the weapon between the firing position and the safety position. These selectors usually allow the weapon to be manually placed in a firing state or safe state.

The manual safety mechanism is based on blocking or impeding the movement of the trigger of the weapon by means of physical interference; this interference impedes the rotation of the trigger such that it does not reach the release point of the hammer and therefore, shooting cannot take place. The intermediate area of the selector is that which interacts with the trigger of the weapon, allowing (firing position) or impeding (safety position) the movement of the rear area of the trigger, as shown in the images incorporated in this specification and which we refer to in the description of a preferred embodiment. If the trigger is impeded from carrying out its usual movement, the rest of the kinematic chain of shooting is disabled, meaning that shooting is impeded.

Among these types of safeties is the one described in US patent application U.S.-2015/068090, referring to a trigger assembly for weapons, consisting of a safety hook anchored to and pivotal with the selector, which impedes the displacement of the hammer in the safety position of the selector. This system comprises two safeties, that of the original selector of the weapon and the safety hook, wherein both act simultaneously; if the manual selector is in the safety position, both safeties are in the safety position, whereas if the manual selector is in the firing position, both safeties are in the firing position. This has the disadvantage that when the user places the selector in the firing position by mistake, accidental shooting may occur, thus posing a serious safety concern.

There are other examples that describe safety devices for this type of weapon, as is the case of US patent application U.S.-2016/0187089, which describes a securing system such that when the manual selector is in the safety position, it cannot be switched to the firing position unless an additional system or key is used.

The US patent application U.S.-2015/0253093 describes an additional device to that of the manual selector of the weapon, which is not included on that selector, but which intercepts the kinematic chain of shooting through other added elements. The disadvantage of this type of device is that it occupies a space inside the weapon that can be used to house other types of accessories, such as a battery. Furthermore, it implies making significant modifications to an already existing weapon.

The US patent application U.S.-2016/0061549 describes a device additional to that of the manual safety of the weapon which acts on the rear area of the trigger by means of an element added to the selector.

The US patent application U.S.-2014/305017 describes two ways of independently securing the weapon, one of them being through the original selector of the weapon and the other through interposition of the trigger, introducing an element into the area occupied by the original selector when it is in the safety position. In addition to adding additional elements and not securing the weapon in an additional way through the selector, this system has the disadvantage that when both safeties are in the safety position, they can undergo mechanical wear due to shocks or friction between the two elements.

None of these safety devices allow the weapon to be placed in a safety position independent of the position of the manual safety through the selector. Therefore, it is clear that there is the need to have a safety device that comprises an additional device that is independent from the manual safety through the selector of the weapon and not of the elements added to the weapon, which occupy usable space in the weapon to house other devices or elements, and that can be controlled mechanically or electronically by the user that carries the weapon or by another controlling user remotely and additionally to the user that carries the weapon.

DESCRIPTION OF THE INVENTION

The present invention relates to a device for securing weapons, additional to the manual safety through the selector, which comprises an additional securing mechanism, such that the safe state in any of the two systems, the manual safety or the additional mechanism, prevails, such that if any of the two are in the safety position, the weapon is in the safety position. This way, the semi-automatic and automatic weapons are secured in two different and independent ways through the selector, such that the original function of selector is maintained and, furthermore, an additional safety that is independent from it is included, which can be controlled mechanically or electronically by the user who carries the weapon or remotely by another controlling user.

The device for securing firearms that is proposed by the invention comprises a trigger and a first safety that in turn comprises a selector and a shaft that comprises a recess, such that the selector determines the state of the weapon, between at least a firing state, in which the recess of the shaft faces the trigger and allows it to be actuated, and a safe state, in which the recess does not face the trigger, such that contact between the shaft and that trigger prevents it from being actuated.

Therefore, according to the invention, the device comprises a second safety which operates independently from the first safety, said second safety comprising an actuating element and a safety body, such that the second safety determines the state of the weapon, between at least a firing state, in which the safety body is not in the space of the shaft defined by the recess, and a safe state, in which the safety body is, at least partially, in the space of the shaft defined by the recess. The actuating element and the safety body are made from a single piece or independent pieces joined together when they move.

This invention is especially useful, but not for the exclusive use of shooting galleries, where inexperienced users participate in shooting sessions for training purposes. A controlling user can control the state of all the weapons present in the gallery through this additional safety included on the new selector. Inexperienced users control the state of the weapon through the manual safety, but a controlling user controls the additional safety, such that any weapon can be enabled/disabled at any time through the additional safety, thereby preventing possible accidents.

We can schematically see the operation of the first safety (manual safety) and the second safety (additional safety), as well as the state of the weapon in the following table. The position of the safeties can be "safety" or "firing", while the state of the weapon switches between "safe weapon" and "enabled weapon".

The following table, which we have referred to, is attached and represents the state of the weapon with the placement of the first and second safeties on the weapon.

| Manual safety position | Additional safety position | State |
|---|---|---|
| Safety | Safety | Safe weapon |
| Firing | Safety | Safe weapon |
| Safety | Firing | Safe weapon |
| Firing | Firing | Enable weapon |

Throughout the specification, when "manual safety" is mentioned, it is the same as saying "first safety", and when "additional safety" is mentioned, we refer to the "second safety".

In the first row, one can see that the first safety called "manual safety" and the second safety called "additional safety" are in the "safety" position and therefore, the weapon is a "safe weapon" and therefore, cannot be shot.

In the second row of the table, we can see that the first safety is in the "firing" position while the second safety is in the "safety" position; therefore, this second safety disables the weapon, and therefore, it is a "safe weapon".

In the third row of the table, we can see that the first safety is in the "safety" position while the second safety is in the "firing" position; therefore, the first safety disables the weapon, and therefore, it is a "safe weapon".

In the fourth row of the table, we can see that the first safety is in the "firing" position while the second safety is in the "firing" position; therefore, neither safety disables the weapon, and therefore, it is an "enabled weapon", in other words, it can be shot.

Among the important characteristics of this device is the fact that the second safety can be actuated very quickly, since its movement has a very small magnitude, such that switching from the "firing" position to the "safety" position is almost instantaneous. For example, when an inexperienced user participates in training sessions and leaves the first safety in the "firing" position due to their inexperience, a controlling user can switch that weapon to the "safety" position almost instantaneously thanks to this device, by means of the second safety; this situation is shown in rows 4 and 2 of the table, where the actuation of the second safety would switch from "enabled weapon" to "safe weapon", respectively.

A second characteristic of this device is that said second safety maintains the "safety" order. If both safeties are in the firing position of the weapon, the weapon is enabled for shooting. When the user is pressing the trigger, said trigger occupies the recess area of the first safety. If in that moment the "safety" order of the second safety is sent, the safety body of the second safety will try to occupy the recess of the first safety, and will not be able to do so until the trigger is released and the trigger leaves the recess, a moment the safety body will take advantage of in order to enter the recess area of the first safety and, as a result, leave the weapon in the safety position.

The safety body of the second safety comprises elastic means that in the absence of an external driver tend to keep the second safety in a "safe" state.

The safety body that forms the second safety, as foreseen, will occupy the recess of the first safety and will have a shape and dimensions so that its actuation will impede the movement of the trigger and therefore, prevent shooting of the weapon, leaving it in a "safe weapon" position. A preferred embodiment would consist in having the path of the trigger be the same in the "safety" position of the second safety as in the "safe" position of the first safety.

Until now, it has been mentioned that the safety body of the second safety will occupy the recess of the first safety, switching the weapon from an "enabled weapon" position to a "safe weapon" position. This movement of the safety body can be carried out in multiple ways, for example, by means of longitudinal movement along the shaft of the first safety, occupying a displaced position with respect to the recess or a position in the area of the recess; or it can be carried out by means of radial movement to the shaft of the first safety, occupying a retractable position with the recess or being expanded in such a way that impedes the movement of the trigger. In this second case, even the movement of the safety body would raise the body of the trigger, placing the weapon in the "safe weapon" position.

Furthermore, through the device of the invention, the state of the weapon is controlled through the control of the selector from one side of the weapon. It is controlled from the right side of the receiver; however, it can be equally controlled from the left side of the receiver. The device can be used symmetrically, for users who prefer to control the manual safety from the right side of the weapon. The original functionality of the selector is maintained at all times. The reversibility of the system is maintained, being able to leave the weapon in its original state when reinstalling the replaced components.

The driver on the second safety is mechanical and comprises a cam located on one end of the actuator. This mechanical driver is housed in a body attached to the weapon, an attached body inside of which there is an electric motor operatively connected to a geared mechanism that is operatively connected to the cam, such that the cam can only be actuated by said electric motor. The electric motor is powered by a battery, such that in the absence of battery power, the state of the second safety can be selected.

Optionally, the driver on the second safety can be electronic and even remote.

The driver on the second safety is housed either inside the weapon or on the outside of the weapon. If said device is outside of the weapon, the device is located in an area external to the surface defined by the trigger, the device for releasing the magazine of the weapon and the grip of the weapon, in order to avoid hindering the normal movement of the shooter in case the users wish to push the button to change the magazine and therefore avoid any other obstacle when carrying out this operation.

It is an object of the present invention is the method for securing firearms that comprises a first safety and a second safety, the latter being independent of the first safety of the weapon, wherein the first safety and second safety adopt "safety" or "firing" positions, leaving the weapon enabled only when both first and second safeties are in the respective "firing" positions and, changing the second safety from the "firing" position to the "safety" position by means of the movement of a safety body from a position in which it does not hinder the movement of the trigger to a position in which it hinders the movement of the trigger and impedes its movement caused by the action of the trigger.

One important characteristic is that the second safety maintains the "safety" order, because if the trigger occupies the recess area of the first safety and at that time the "safety" order of the second safety is sent, the safety body will try to occupy the recess of the first safety, not being able to carry out its movement until the trigger is released and the trigger leaves the recess of the first safety, a moment the safety body will take advantage of in order to enter the recess area of the first safety and, as a result, leave the weapon in the "safety" position.

DESCRIPTION OF THE DRAWINGS

As a complement to the description provided herein, and for the purpose of helping to make the characteristics of the invention more readily understandable, in accordance with a preferred practical embodiment thereof, said description is accompanied by a set of figures constituting an integral part of the same, which by way of illustration and not limitation represent the following.

PREFERRED EMBODIMENT OF THE INVENTION

Figure 1:
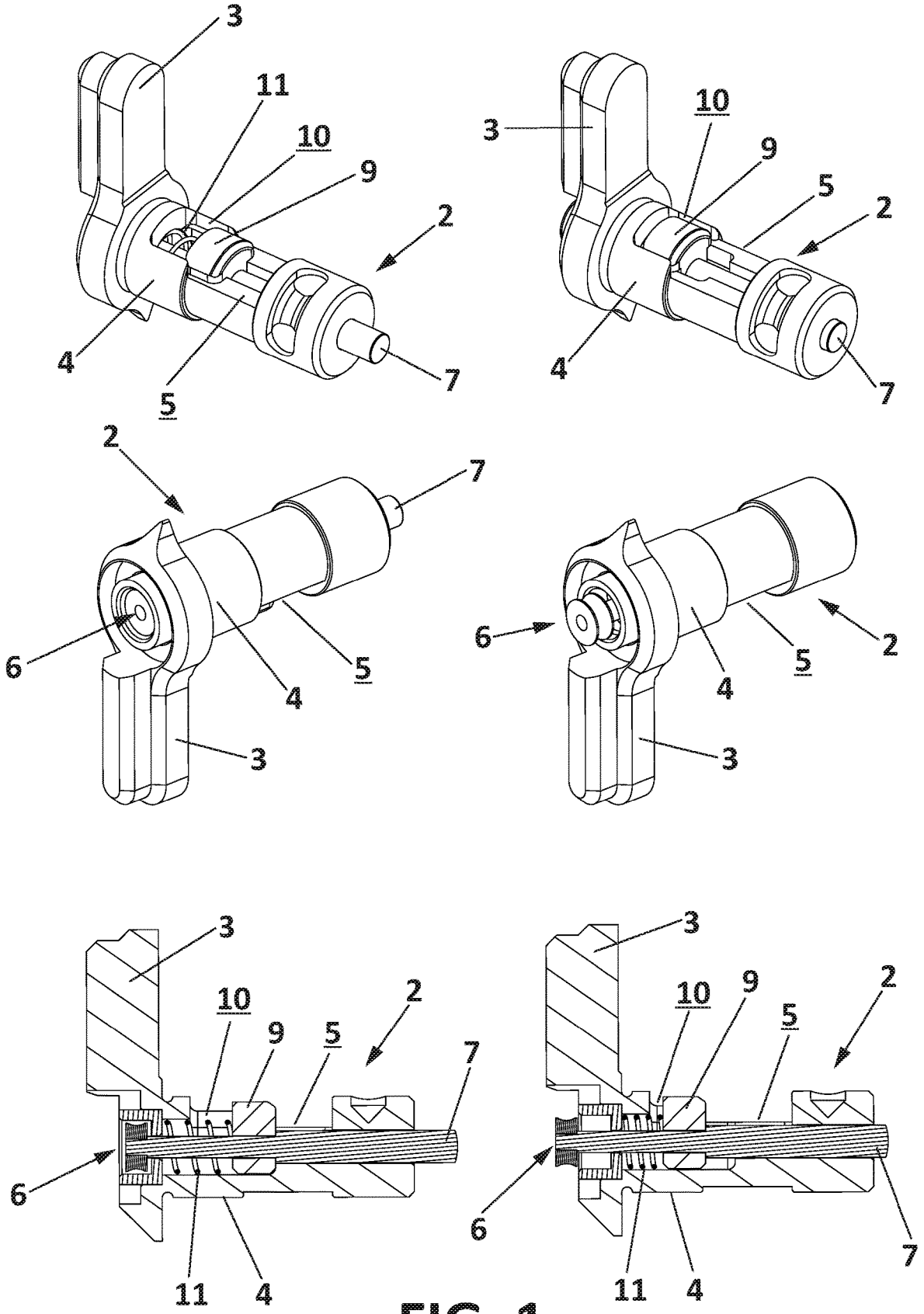
FIG. 1 shows four perspective views and two longitudinal cross sections of a first embodiment of the device of the invention, which shows the second safety in a safe state on the left and in a firing state on the right.
Figure 2:
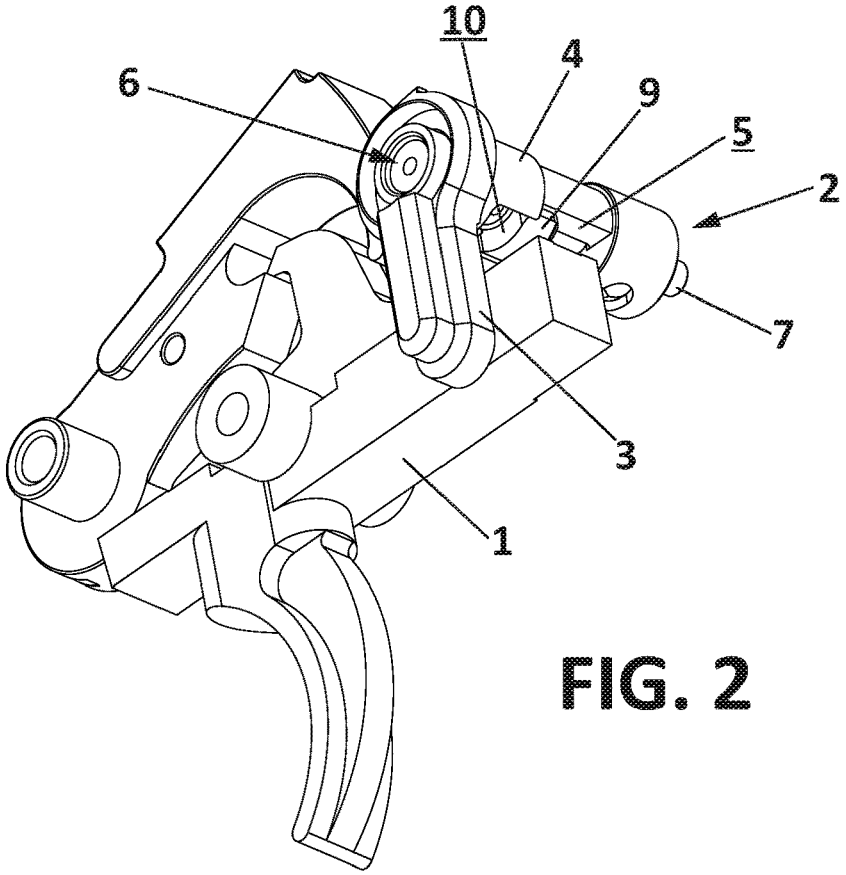
FIG. 2 shows a perspective view of the device of the invention incorporated on a weapon, with the second safety in a safe state.
Figure 3:
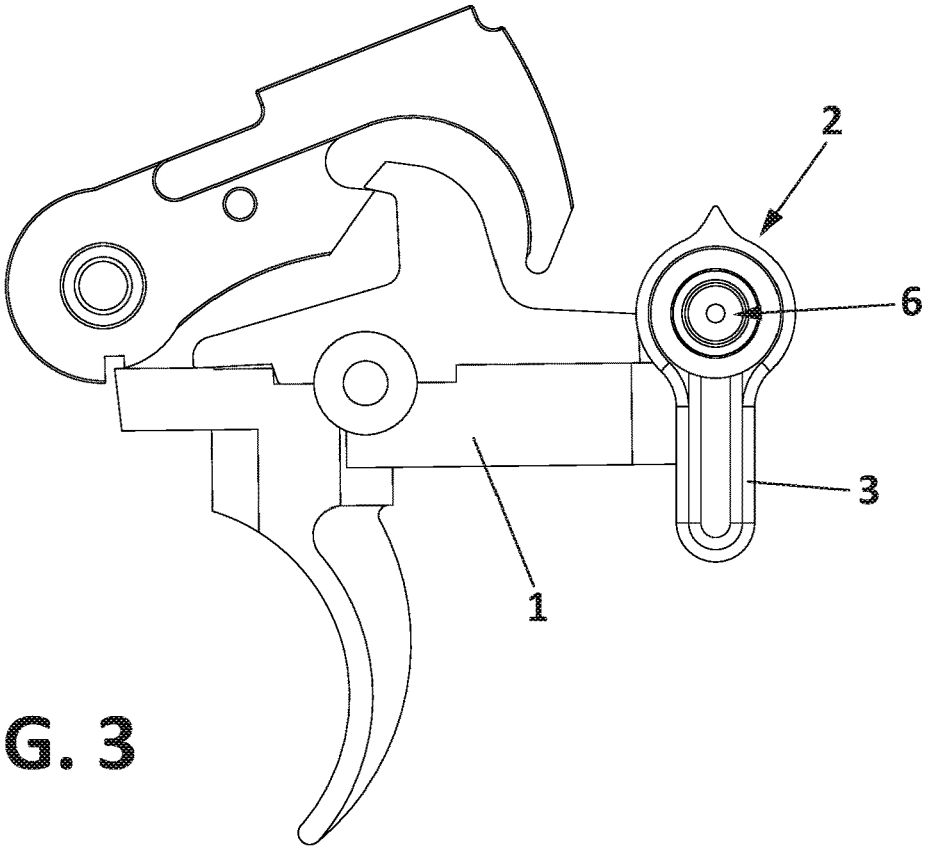
FIG. 3 shows a side view of the shooting device of the weapon, in which the interaction between the trigger and the first and second safety of the weapon is shown.
Figure 4:
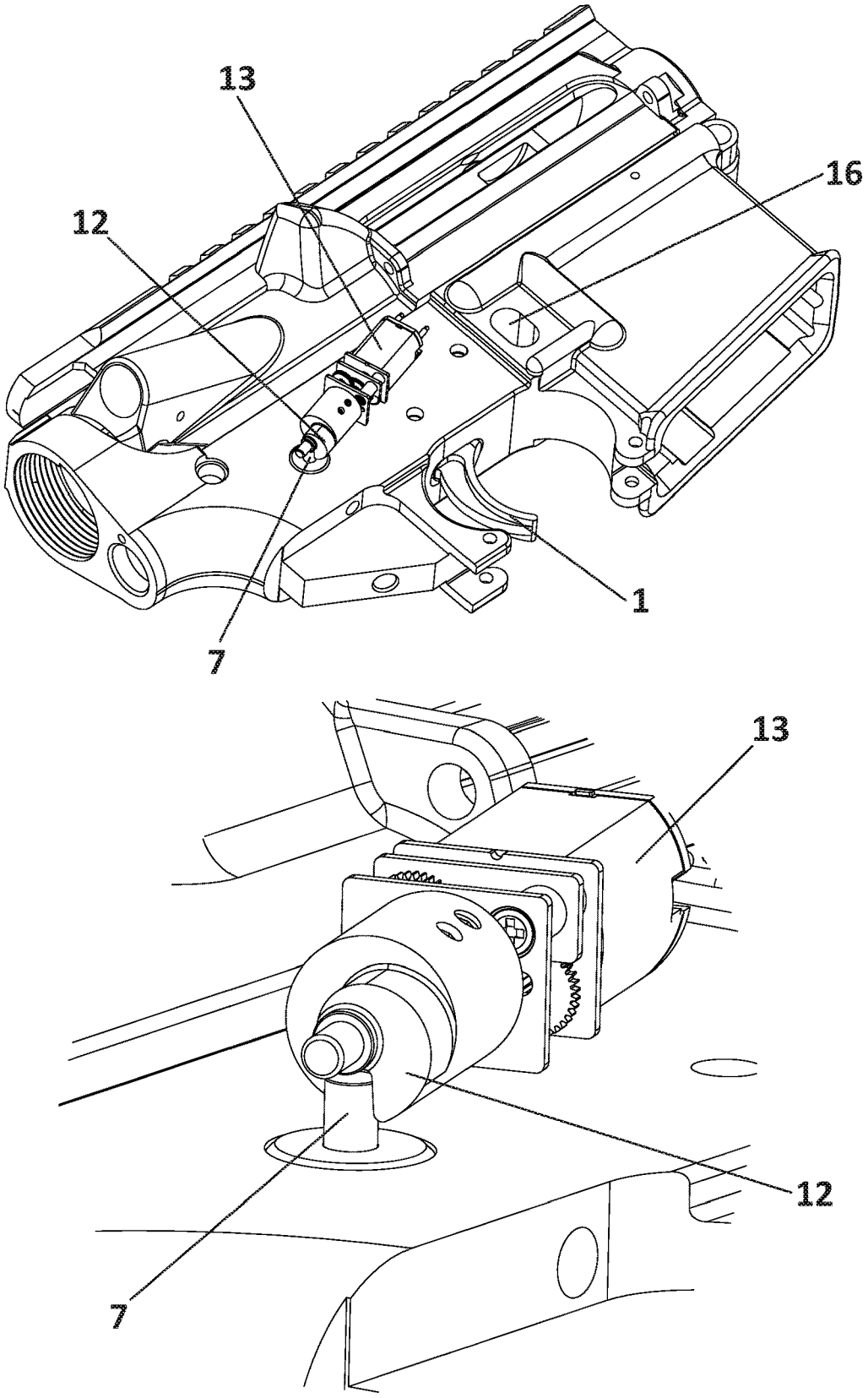
FIG. 4 shows two perspective views of the cam and the electric motor of the driver.

In light of the figures discussed above, it may be seen how in one of the possible embodiments of the invention, the device for securing firearms that the invention proposes comprises a trigger (1) and a first safety (2) that in turn comprises a selector (3) and a shaft (4) that comprises a recess (5), such that the selector (3) determines the state of the weapon, between at least a firing state, wherein the recess (5) of the shaft (4) faces the trigger (1) and allows it to be actuated, and a safe state, wherein the recess (5) does not face the trigger (1), meaning that contact between the shaft (4) and that trigger (1) impedes it from being actuated.

The device comprises a second safety (6), the actuation of which is independent of the first safety (2), said second safety (6) comprising an actuator element (7) and a safety body (9), such that the second safety (6) determines the state of the weapon, between at least a firing state, wherein the safety body (9) is not in the space of the shaft (4) defined by the recess (5), and a safe state, wherein the safety body (9) is, at least partially, in the space of the shaft (4) defined by the recess (5). This second safety (6), the actuation of which is independent of the first safety (2), comprises an actuator element (7) and a safety body (9), made from a single piece or independent pieces joined together in their movement.

It is envisaged that the actuator (7) consists of an auxiliary shaft that can be moved along a central hole (8) that crosses the center of the shaft (4) of the first safety (2), said actuator (7) being secured to the safety body (9).

Likewise, it is envisaged that, in the firing position of the second safety (6), the safety body (9), belonging to that second safety (6), is located on a housing (10) that has the shaft (4) of the first safety (2) outside of the space defined by the recess (5).

Figure 5:
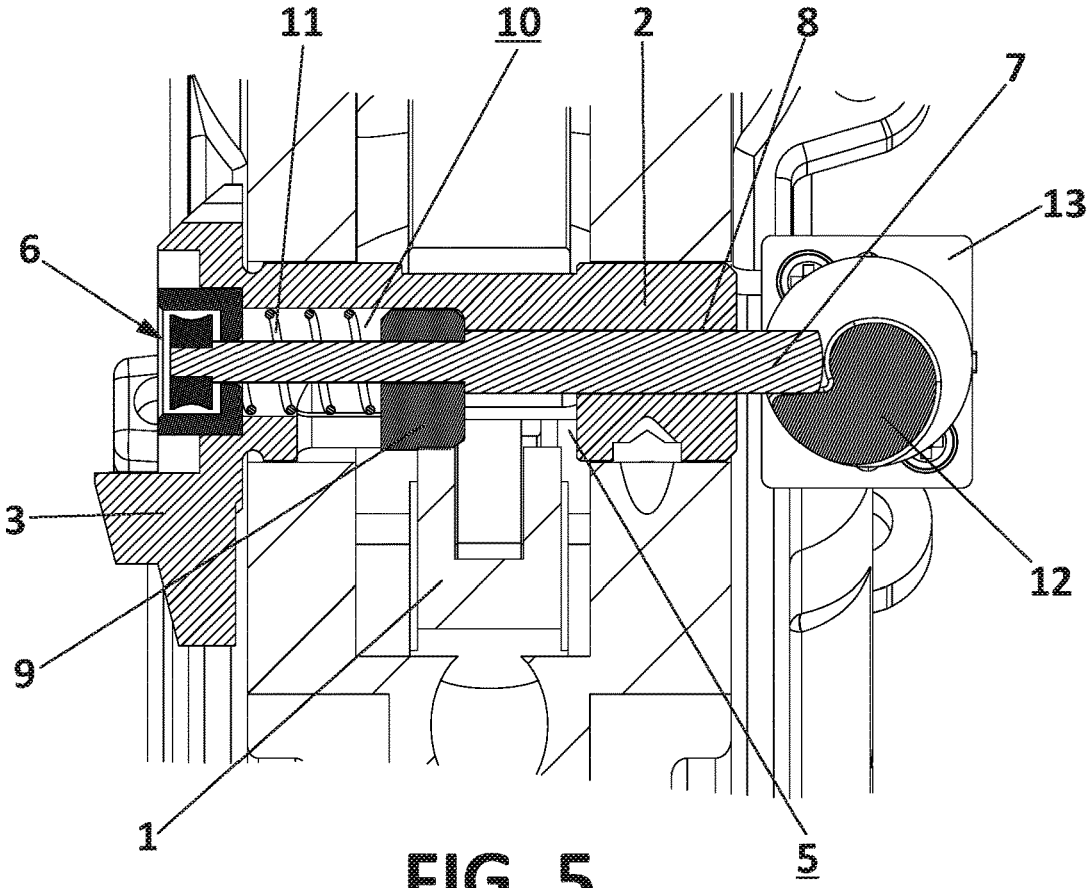
FIGS. 5 and 6 show a longitudinal cross section of the device, wherein the first safety in both figures is in the "firing position", and the second safety in the first figure is in the "safety" position and that in the second figure is in the "firing" position.
Figure 6:
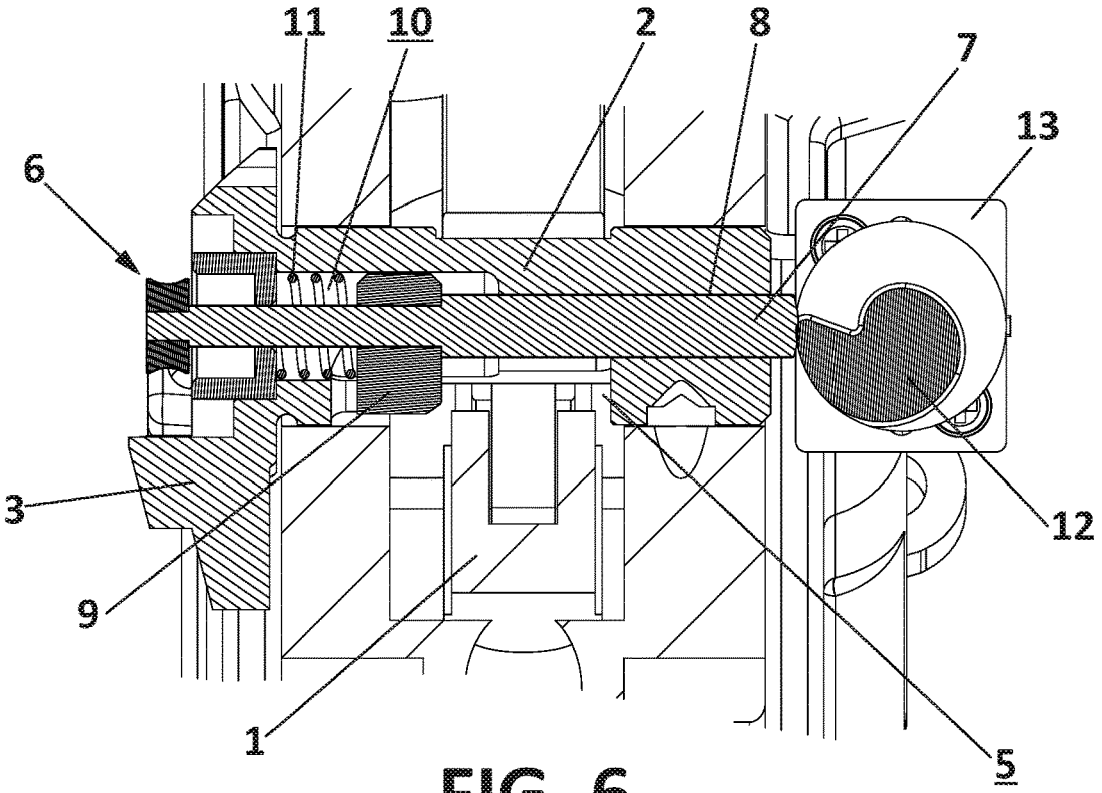

As shown in FIGS. 5 and 6, it is envisaged that the device comprises elastic means (11) that in the absence of an external driver tend to keep the safety body (9) of the second safety (6) in a safe state. As shown, the dimensions of the safety body (9) that block the position of the trigger (1) make the path of the trigger (1) the same in the "safety" position of the second safety (6) as in the "safety" position of the first safety (2). In both FIGS. 5 and 6, it is observed how the first safety (2) is in the "firing" position, and the second safety (6) is in the "safety" position in FIG. 5 and in the "firing" position in FIG. 6, since in FIG. 6 the safety body (9) does not intercept the range of the movement of the trigger (1).

The driver on the second safety (6) can be mechanical and comprise, preferably, a cam (12) located on one end of the actuator (7) opposite to the end of the selector (3). In this case, the mechanical driver is housed in a body attached to the weapon, inside of which there is an electric motor (13) operatively connected to a geared mechanism that is operatively connected to the cam (12), such that the cam (12) can only be actuated by said electric motor (13). The motorization system incorporates limit switches to control the position of the electric motor (13), such that the positioning of the cam (12) which interacts with the actuator (7) is known at all times.

In FIG. 6, wherein the second safety (6) is in the "firing" position, it can be observed how the cam (12) is located in a position of maximum eccentricity with respect to the actuator (7) and therefore, compresses the elastic means (11) and moves the safety body (9) from the area of the recess (5), and therefore, from the trigger (1). For quick actuation of the actuator (7), switching the second safety (6) from the "firing" position to the "safety" position, the cam (12) is rotated counterclockwise, making the actuator (7) jump in its contact with the cam (12) from the area of maximum eccentricity, FIG. 6, to the area of minimum eccentricity, FIG. 5, in other words, with a small angular movement of the cam (12) the safety body (9) is moved to the area of the recess (5) and therefore, to the "safety" position of the second safety (6), which implies very fast actuation in the positioning of the second safety (6) as a "safety" position.

It is envisaged that the electric motor (13) is powered by a battery, such that in the absence of battery power, the state of the second safety (6) can be selected. On the other hand, it is envisaged that the driver on the second safety (6) is electronic.

In any case, according to an embodiment, the driver of the second safety (6) can be remote.

It is envisaged that the end located in the area corresponding to the selector (3) of the actuator (7) comprises an indicator of the state of said second safety (6). The device incorporates a visual indicator of the state for the additional system. The indicator of the state is secured to the shaft (4) of the first safety (2), such that when this safety moves, the indicator becomes visible in the "firing" position, and is hidden in the "safety" position. The visual indicator is located on the accessible side of the selector (3), along with the position indications.

Figure 7:
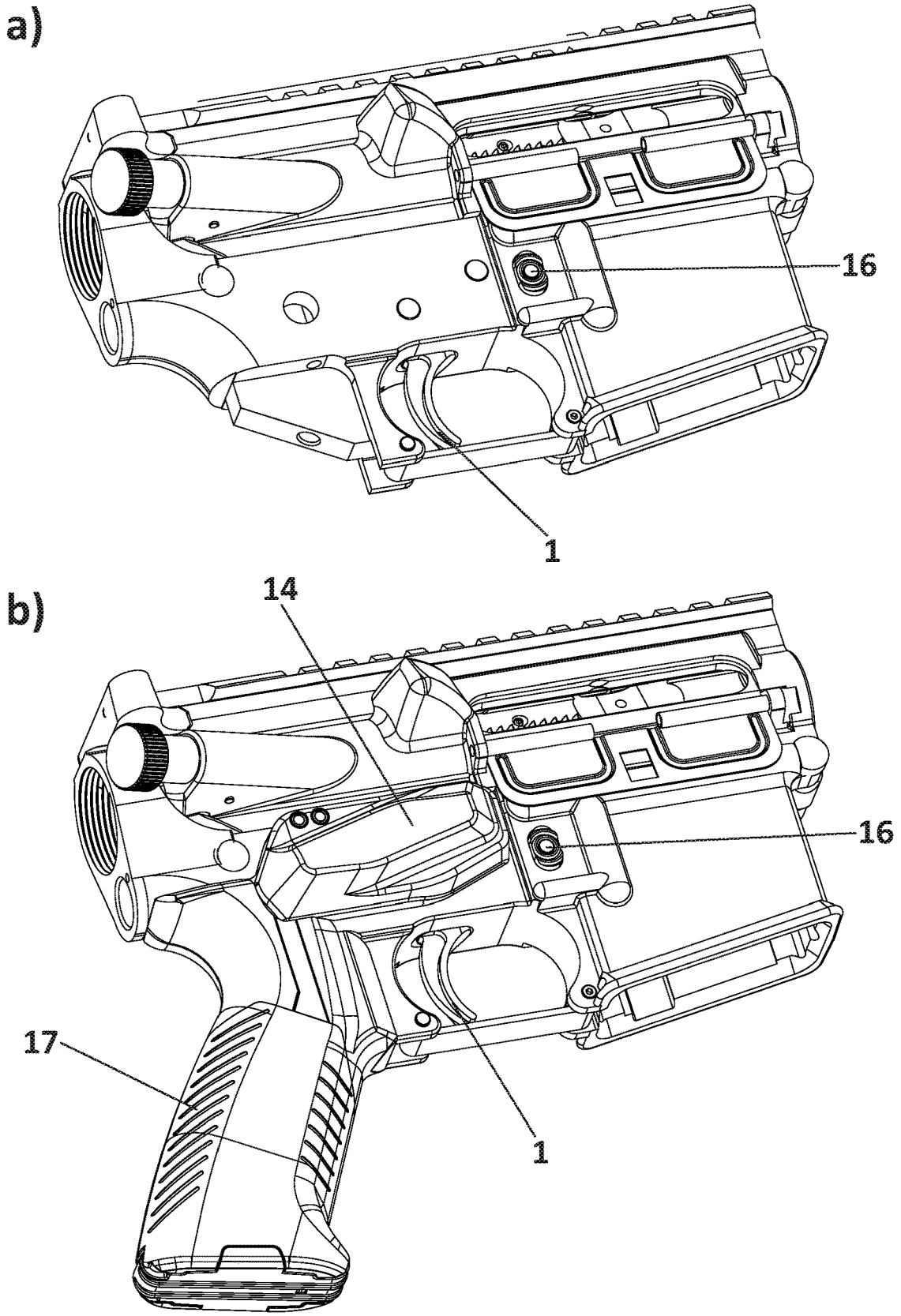
FIGS. 7 and 8 show perspective views of the incorporation of the device of the invention on an already existing weapon.
Figure 8:
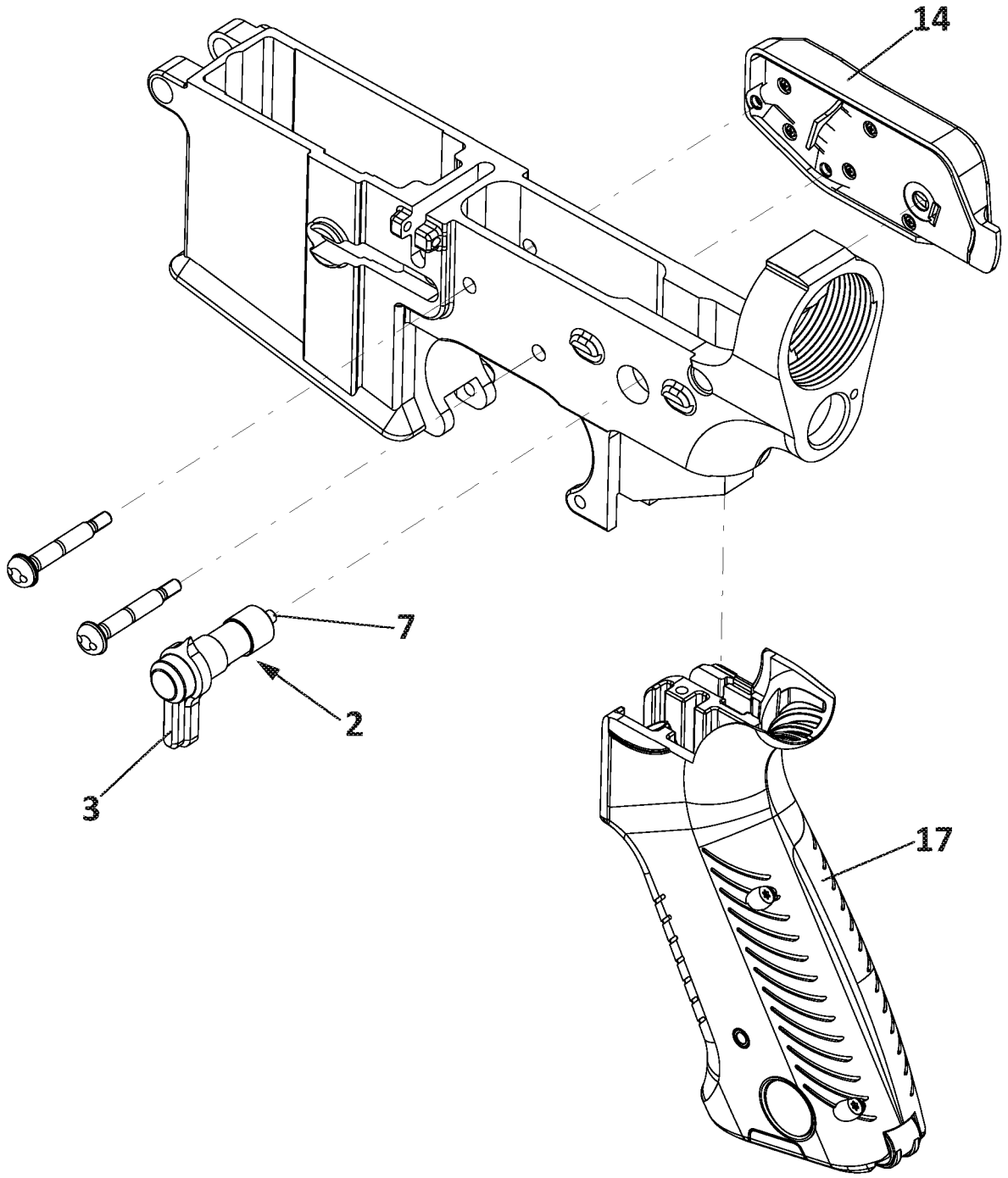

It is envisaged that the driver on the second safety (6) is housed inside the weapon, FIG. 7*a*, not shown in said figure because it is inside the weapon, or that the driver, represented by the protective casing (14) on the second safety (6) is housed on the outside of the weapon, as shown in FIG. 7*b*, being located in an area external to the surface defined by the trigger (1), the device for releasing the magazine of the weapon (16) and the grip of the weapon (17), as can be better observed in FIG. 7*b*.

FIGS. 9 to 14 show a plurality of variants of the embodiment of the device of the invention.

Figure 9:
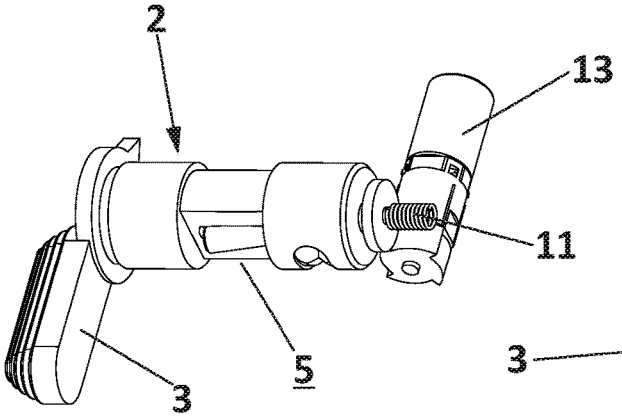
FIGS. 9 to 14 show a plurality of variants of the embodiment of the device of the invention.

For example, FIG. 9 shows a view of the proposed device, wherein the electric motor (13) drives a cogwheel that in turn moves the actuator, which will create longitudinal movement along a shaft inclined with respect to the first safety (2) and with this movement, it will occupy the recess (5) of the first safety (2).

Figure 10:
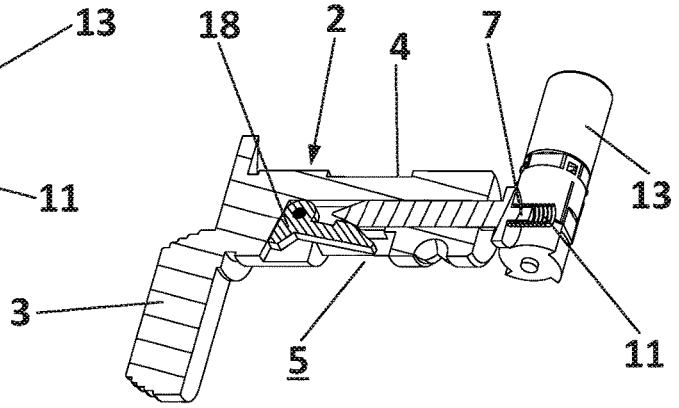

In FIG. 10, the electric motor (13) drives a cogwheel which in turn moves the actuator (7) which will create longitudinal movement along the shaft (4) of the first safety (2) and with that movement, it will act upon a bolt (18) that will occupy the recess (5) of the first safety (2).

Figure 11:
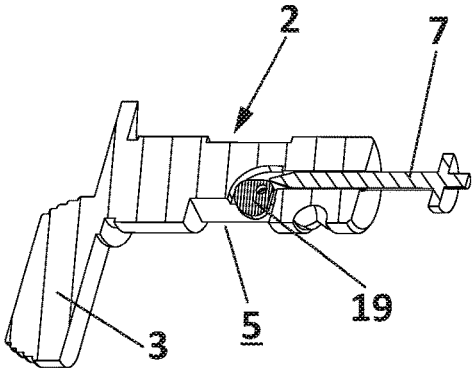
Figure 12:
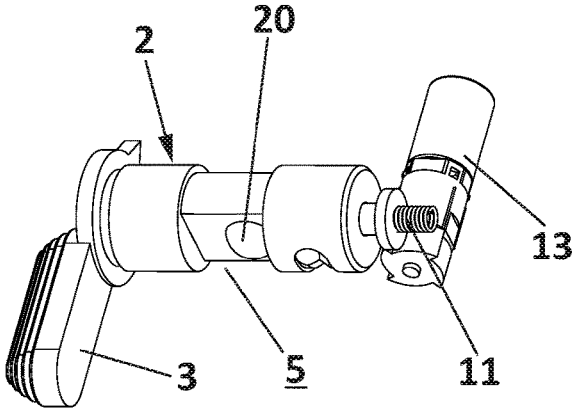

In FIG. 11, the actuator (7) will drive with its movement an eccentric body (19) that occupies the recess (5). FIG. 12 shows an equivalent mechanism wherein that which is moved is a ball body (20) that enters the recess (5) to impede or facilitate the movement of the trigger.

Figure 13:
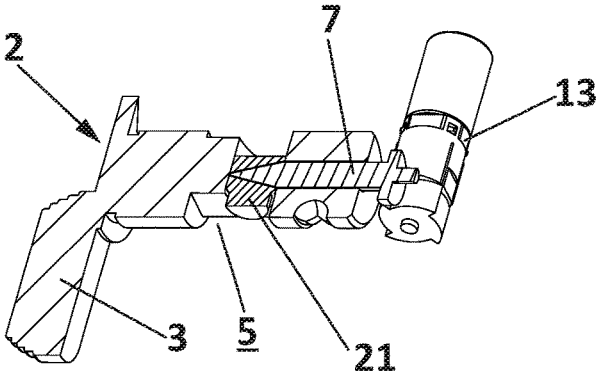

FIG. 13 shows how the actuator (7) drives a cylindrical body (21) that makes a transverse movement with respect to the movement of the actuator (7) in order to occupy a position of retraction or deployment of said cylindrical body (21) inside the recess (5).

Figure 14:
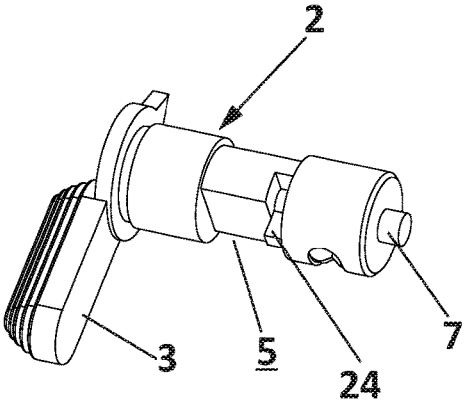

FIG. 14 shows the solution by means of a latch (24) driven by rotation by means of the actuator (7).

In all cases described, the actuator (7) carries out an action to introduce or retract a body from the inside of the recess (5) and, with that operation, to allow or impede the movement of the trigger (1) at the will of the user of the weapon or a controlling user.

In view of this description and the set of figures, a person skilled in the art will understand that the embodiments of the invention that have been described can be combined in multiple ways within the object of the invention. The invention has been described according to preferred embodiments thereof, but for the person skilled in the art, it will be evident that multiple variations can be introduced in said preferred embodiments without departing from the object of the invention as has been claimed.

The invention claimed is:

1. A device for securing a firearm having a trigger (1) comprising:

a first safety (2) including a selector (3) and a shaft (4), wherein the shaft (4) comprises a recess (5), and wherein the selector (3) determines the state of a firearm such that when the firearm is in a firing state the recess (5) of the shaft (4) faces the trigger (1) and allows the trigger (1) to be actuated, and wherein when the firearm is in a safe state the recess (5) does not face the trigger (1) such that contact between the shaft (4) and the trigger (1) impedes the trigger (1) from being actuated; and a second safety (6), comprising an actuator element (7) and a safety body (9), wherein the second safety (6) determines the state of the firearm such that when the fire arm is in a firing state the safety body (9) is not in a space of the shaft (4) defined by the recess (5), and when the fire arm is in a safe state the safety body (9) is, at least partially, in the space of the shaft (4) defined by the recess (5), wherein the actuator element (7) consists of an auxiliary shaft that can be moved along a central hole (8) that crosses a center of the shaft (4) of the first safety (2), said actuator element (7) being secured to the safety body (9).

2. The device according to claim 1, wherein in the firing position of the second safety (6), the safety body (9) is located on a housing (10) that has the shaft (4) of the first safety (2) outside of the space defined by the recess (5).

3. The device according to claim 1, characterized in that the dimensions of the safety body (9) that blocks the position of the trigger (1) make the path of the trigger (1) the same in the safe state of the second safety (6) as in the safe state of the first safety (2).

4. The device according to claim 1, which comprises elastic means (11) that in an absence of an external driver keeps the second safety (6) in the safe state.

5. The device according to claim 1, wherein a driver on the second safety (6) is mechanical and comprises a cam (12) located on one end of the actuator element (7) opposite to an end of the selector (3).

6. The device according to claim 5, wherein the driver is housed in a body attached to the weapon, inside of which there is an electric motor (13) operatively connected to a geared mechanism that is operatively connected to the cam (12), such that the cam (12) can only be actuated by said electric motor (13).

7. The device according to claim 6, characterized in that the electric motor (13) is powered by a battery, such that in the absence of battery power, the state of the second safety (6) can be selected.

8. The device according to claim 5, wherein the driver on the second safety (6) is remote.

9. The device according to claim 1, wherein a driver on the second safety (6) is electronic.

10. The device according to claim 1, wherein the end located in the area corresponding to the selector (3) of the actuator (7) comprises an indicator of the state of said second safety (6).

11. The device according to claim 1, characterized in that a driver on the second safety (6) is housed inside the weapon.

12. The device according to claim 1, characterized in that a driver on the second safety (6) is housed on the outside of the weapon.

13. The device according to claim 12, characterized in that said device is in an area external to a surface defined by the following elements: the trigger (1), a device for releasing the magazine of the firearm (16), and a grip of the firearm (17).

* * * * *